US008272692B1

(12) United States Patent
Epperson

(10) Patent No.: US 8,272,692 B1
(45) Date of Patent: Sep. 25, 2012

(54) OFFICE CHAIR HAVING TILTABLE SEAT AND BACK

(76) Inventor: Ronald B. Epperson, Southside, AL (US)

( * ) Notice: Subject to any disclaimer, the term of this patent is extended or adjusted under 35 U.S.C. 154(b) by 168 days.

(21) Appl. No.: 12/908,146

(22) Filed: Oct. 20, 2010

Related U.S. Application Data

(60) Provisional application No. 61/279,684, filed on Oct. 26, 2009.

(51) Int. Cl.

| | |
|---|---|
| ***A47C 3/025*** | (2006.01) |
| ***A47C 3/026*** | (2006.01) |
| ***A47C 1/024*** | (2006.01) |
| ***A47C 1/038*** | (2006.01) |

(52) U.S. Cl. ..... 297/300.3; 297/296; 297/297; 297/298; 297/300.1; 297/300.2; 297/300.7; 297/300.8; 297/316

(58) Field of Classification Search ..... 297/296, 297/297, 298, 300.1, 300.2, 300.3, 300.7, 297/300.8, 316

See application file for complete search history.

(56) References Cited

U.S. PATENT DOCUMENTS

| | | | | | |
|---|---|---|---|---|---|
| 2,083,838 | A | * | 6/1937 | Goenen | 297/298 |
| 4,143,910 | A | * | 3/1979 | Geffers et al. | 297/300.3 |
| 4,198,094 | A | * | 4/1980 | Bjerknes et al. | 297/300.7 X |
| 4,200,332 | A | * | 4/1980 | Brauning | 297/300.3 |
| 4,640,548 | A | * | 2/1987 | Desanta | 297/300.3 |
| 4,682,815 | A | * | 7/1987 | Steifensand | 297/300.3 |
| 4,684,173 | A | * | 8/1987 | Locher | 297/300.3 |
| 4,709,962 | A | * | 12/1987 | Steinmann | 297/300.3 |
| 4,761,033 | A | * | 8/1988 | Lanuzzi et al. | 297/300.3 |
| 4,765,679 | A | * | 8/1988 | Lanuzzi et al. | 297/300.3 |
| 4,911,501 | A | * | 3/1990 | Decker et al. | 297/300.8 |
| 5,046,780 | A | * | 9/1991 | Decker et al. | 297/300.8 |
| 5,121,934 | A | * | 6/1992 | Decker et al. | 297/300.8 |
| 5,425,566 | A | * | 6/1995 | Buchacz | 297/300.3 X |
| 5,486,035 | A | | 1/1996 | Koepke | |
| 5,573,303 | A | | 11/1996 | Doerner | |
| 5,605,376 | A | | 2/1997 | Kogai | |
| 5,660,439 | A | * | 8/1997 | Unwalla | 297/316 |
| 5,871,256 | A | | 2/1999 | Kogai | |
| 6,109,694 | A | | 8/2000 | Kurtz | |
| 6,161,897 | A | | 12/2000 | Kurtz | |
| 6,234,573 | B1 | | 5/2001 | Roder | |
| 6,238,000 | B1 | * | 5/2001 | Hallmark et al. | 297/300.8 X |
| 6,382,719 | B1 | * | 5/2002 | Heidmann et al. | 297/300.1 X |
| 6,523,896 | B1 | * | 2/2003 | Uhlenbrock | 297/300.3 X |
| 6,609,755 | B2 | | 8/2003 | Koepke | |
| 6,739,664 | B2 | * | 5/2004 | Kinoshita et al. | 297/300.3 |
| 6,820,935 | B1 | * | 11/2004 | Cioncada | 297/300.1 |
| 6,913,316 | B2 | * | 7/2005 | Kinoshita et al. | 297/300.3 |
| 6,945,602 | B2 | * | 9/2005 | Fookes et al. | 297/300.2 X |

(Continued)

*Primary Examiner* — Rodney B White
(74) *Attorney, Agent, or Firm* — Neustel Law Offices

(57) ABSTRACT

A chair that includes a support module, a seat carrier, an initially forwardly declined seat member articulated to the seat carrier such as by being pivotal along a front, and an initially rearwardly angled backrest carrier having a backrest member, the carrier articulated to the seat carrier such as by being pivotal along a lower end. The angular positions of the seat and backrest member are largely controlled via an actuator arm and adjustable spring arrangement, wherein the actuator arm directly links the seat member to the backrest carrier and the spring arrangement returns the backrest carrier and seat member to initial positions when a weighted load is lessened or removed from the rear of the seat member. A pneumatic cylinder to provide resistance to the seat member, a limiter to limit a maximum and minimum angular position of the seat member, adjustable arm rests, and casters may be included.

30 Claims, 6 Drawing Sheets

U.S. PATENT DOCUMENTS 7,396,079 B2 * 7/2008 Heidmann et al. ..... 297/285
7,422,287 B2 * 9/2008 Heidmann et al. ..... 297/285 X
7,434,879 B2 * 10/2008 Ueda et al. ..... 297/296
7,497,515 B2 * 3/2009 Cowan et al. ..... 297/300.3
7,665,805 B2 * 2/2010 Ueda ..... 297/301.6
7,686,399 B2 * 3/2010 Heidmann et al. ..... 297/354.1
7,712,833 B2 * 5/2010 Ueda ..... 297/296
7,717,513 B2 * 5/2010 Ueda ..... 297/300.2
7,857,389 B2 * 12/2010 Ueda ..... 297/296
7,862,120 B2 * 1/2011 Ueda ..... 297/297
8,157,326 B2 * 4/2012 Raymond ..... 297/300.3 X
8,177,299 B2 * 5/2012 Fukai ..... 297/300.2

* cited by examiner

OFFICE CHAIR HAVING TILTABLE SEAT AND BACK

CROSS REFERENCE TO RELATED APPLICATIONS

I hereby claim benefit under Title 35, United States Code, Section 119(e) of U.S. provisional patent application Ser. No. 61/279,684 filed Oct. 26, 2009. The 61/279,684 application is currently pending. The 61/279,684 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an office chair and more specifically it relates to an office chair having tiltable seat and back for providing ergonomic seating positions for a user.

2. Description of the Related Art

Any discussion of the related art throughout the specification should in no way be considered as an admission that such related art is widely known or forms part of common general knowledge in the field.

With the ever-increasing use of office chairs, constant attention has been placed upon the advent of creating ergonomic seating positions for a user. One manner in which the office chair has been modified is the development of synchronous tilt control mechanisms so as to permit the simultaneous, but differential, tilting of the seat and back away from the normal upright position of the office chair. For example, the seat may tilt back a first amount or degree, while the back simultaneously tilts back a second amount or degree, with the degree that the back tilts generally being greater than the degree that the seat tilts.

In addition to the rearward tilting mechanisms, many office chairs have also been developed which enable the seat to effectively pivot forwardly from the normal upright position, for example the seat tilting downwardly in a forward direction or declining. The forward tilting movement has been especially desirable in high intensive work environments. However, the incorporation of the forward seat tilt feature with the synchronous differential tilting feature of the seat and back has created additional complications in office chairs.

For example, in office chairs where a forward seat tilt feature has been incorporated in addition to the synchronous differential rearward tilting feature of the seat and back, the synchronous differential tilting relationship between the seat and back continues to function irrespective of whether the seat and back are being tilted forwardly or rearwardly from the normal upright position. Hence, while the rearward tilting feature is satisfactory since the angle between the seat and back increases during such rearward tilting, the forward tilting feature is undesirable since the angle between the seat and back are tilted forwardly from the normal upright position, thus causing a closure of the angle between the seat and back during forward tilt which places stress upon the discs in the spine of the user and causes the user to be uncomfortable in the forward tilt position.

Another disadvantage associated with many of the known office chairs which have attempted to provide both rearward and forward tilt capabilities is the number of control lever arms or buttons which must be activated by the user in order to move the chair into a forward tilt position or rearward tilt position. The control arms and buttons can make use of the office chair confusing, difficult, and time consuming.

Another type of office chair developed to attempt to increase ergonomic seating positions is a user-weight operated feature. Such office chairs, generally without springs, have seat and back portions mechanically linked so the only way to activate back tension or seat movement is by forcing the back rearward. Other types of office chairs with springs, and having seat and back portions mechanically linked, require the user to apply forces upon the back of the chair that overcome the springs to force the back to tilt rearward. Generally, the user must utilize their legs or torso as a weight leverage force to overcome the springs of the office chair and provide the reclining action. In such constructions of office chairs, the difficulty of reclining the office chair generally increases the further the chair is reclined or rearwardly tilted. As made obvious, the rearwardly tilting movement of the chair can be increasingly difficult to control for lightweight and also for heavy users.

Because of the inherent problems with the related art, there is a need for a new and improved office chair having tiltable seat and back for providing an ergonomic forward or rearward tilting movement.

BRIEF SUMMARY OF THE INVENTION

An office chair for providing ergonomic seating positions for a user. The invention relates to an office chair which includes a support module, a seat carrier, an initially forwardly declined seat member articulated to the seat carrier such as by being pivotal along a front, and an initially rearwardly angled backrest carrier having a backrest member, the carrier articulated to the seat carrier such as by being pivotal along a lower end. The angular positions of the seat and backrest member are largely controlled via an actuator arm and adjustable spring arrangement, wherein the actuator arm directly links the seat member to the backrest carrier and the spring arrangement returns the backrest carrier and seat member to initial positions when a weighted load is lessened or removed from the rear of the seat member. A pneumatic cylinder to provide resistance to the seat member, a limiter to limit a maximum and minimum angular position of the seat member, adjustable arm rests, and casters may be included.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
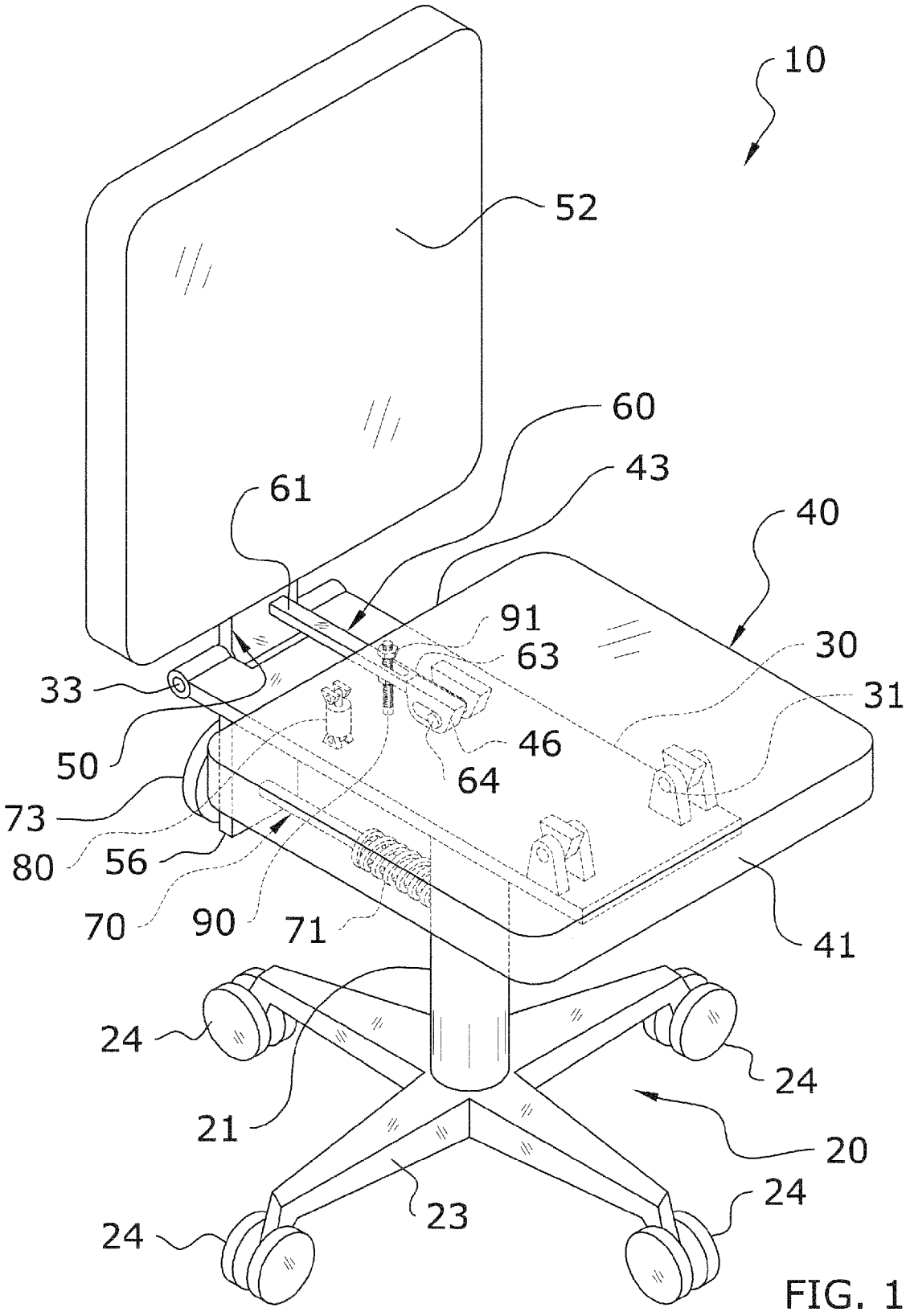
FIG. 1 is an upper perspective view of the present invention.
Figure 2:
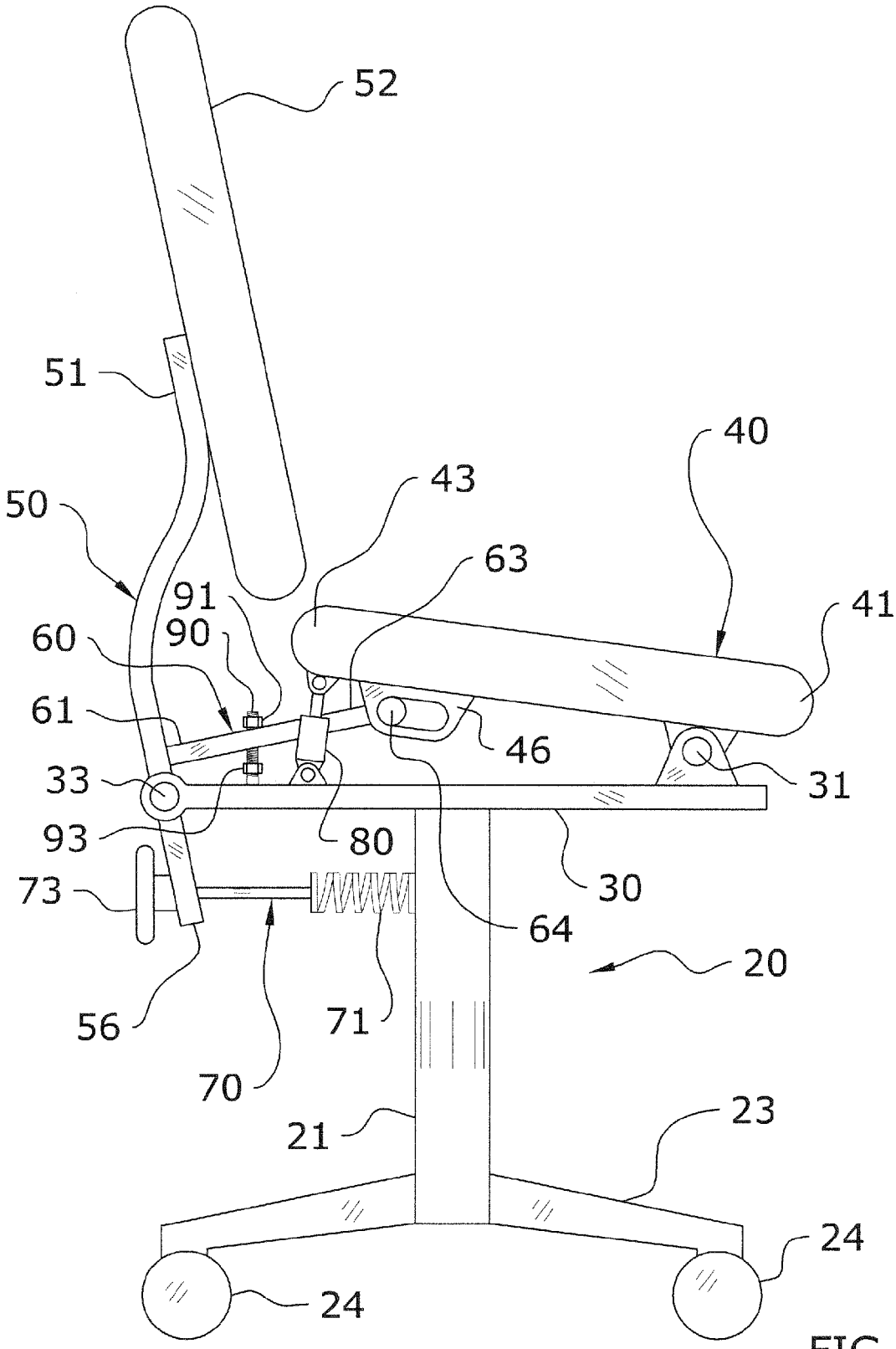
FIG. 2 is a side view of the present invention in the initial (no-load) position.
Figure 3:
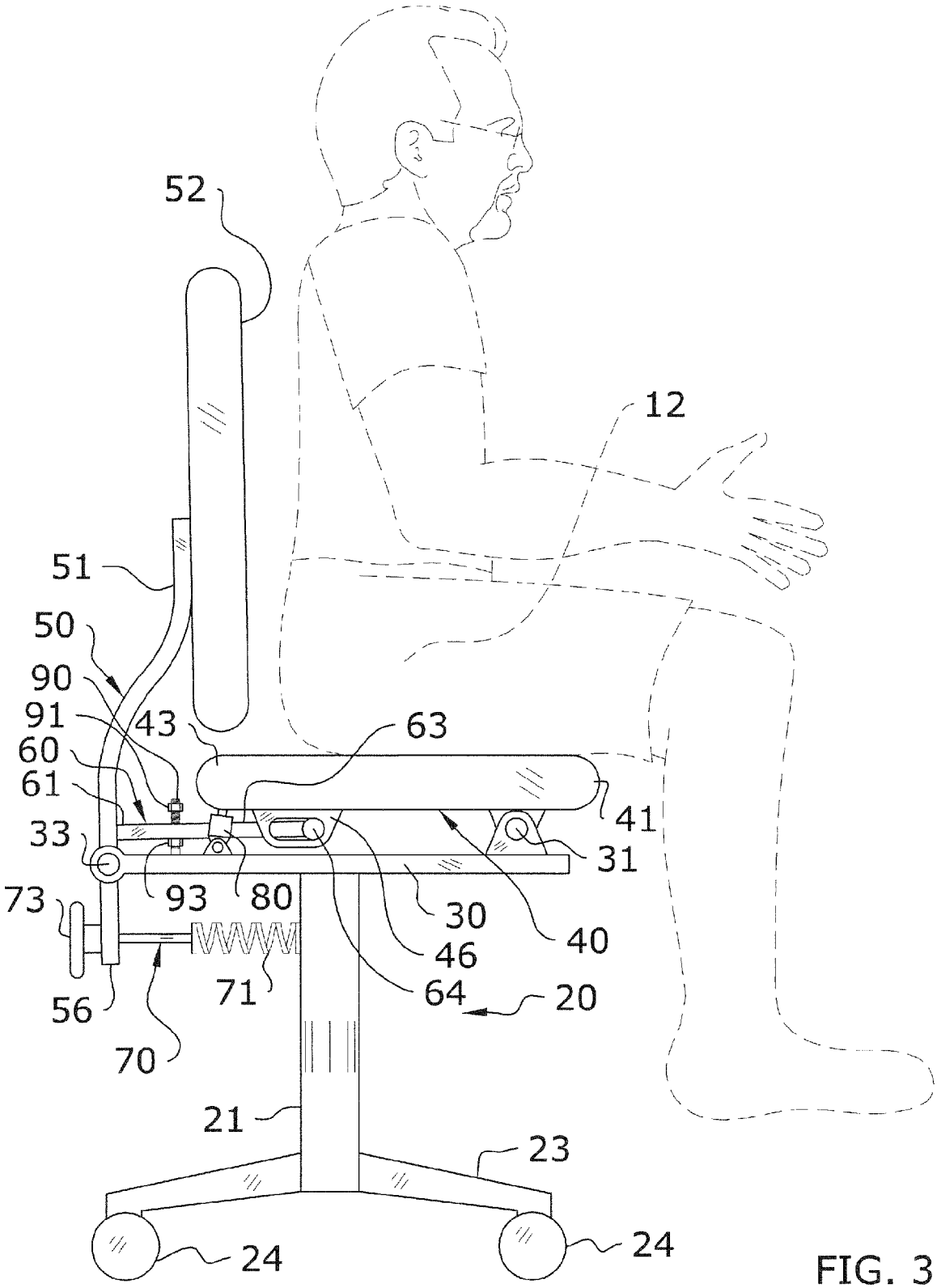
FIG. 3 is a side view of the present invention with a load upon the rear end of the seat member thus causing the seat member to and backrest carrier to pivot to the seated position.
Figure 4:
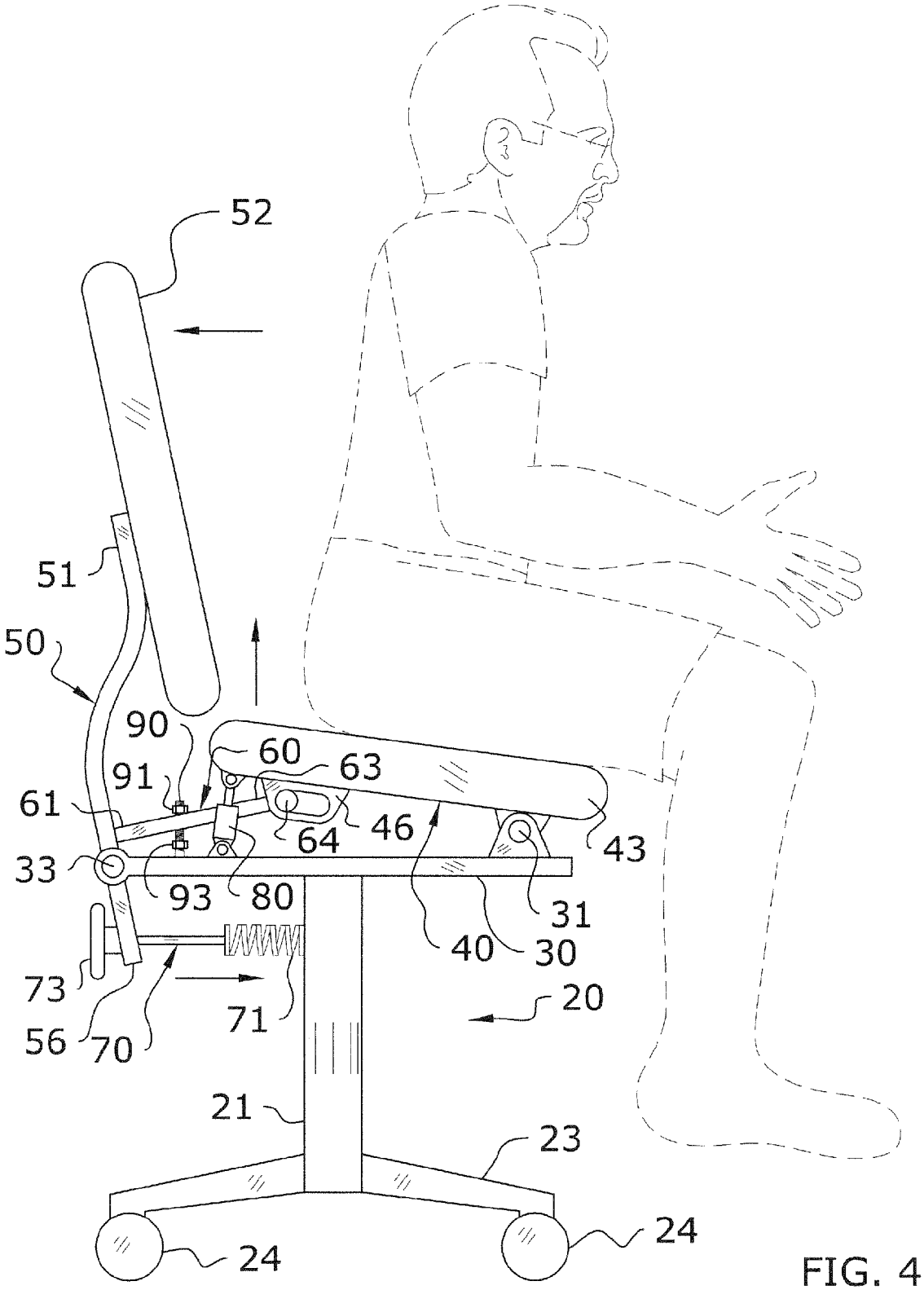
FIG. 4 is a side view of the present invention with a load upon the front end of the seat member thus causing the seat member to and backrest carrier to pivot back towards the initial position.
Figure 5:
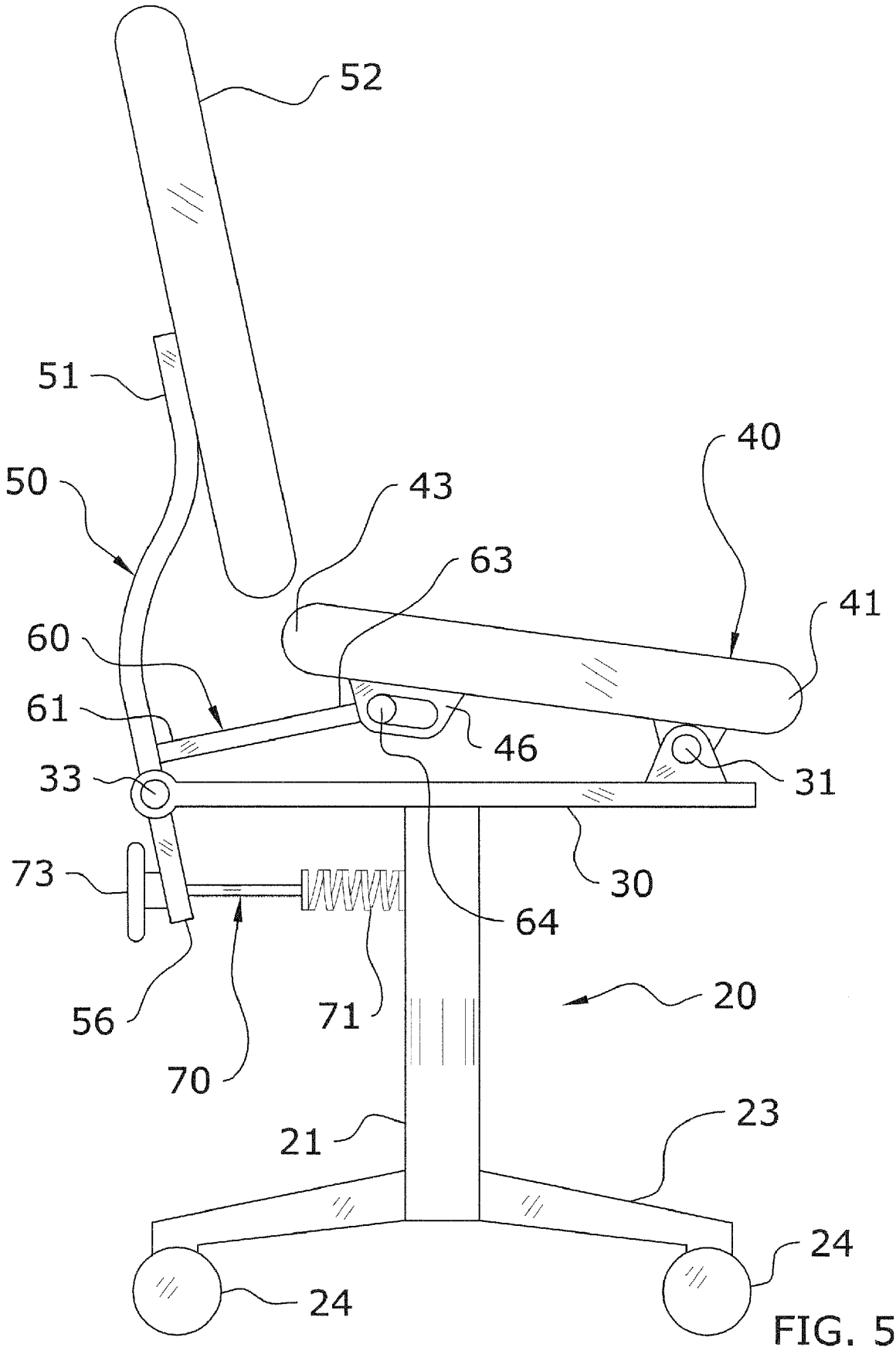
FIG. 5 is a side view of an alternate embodiment of the present invention in the initial (no-load) position and not including the stop limiter or pneumatic cylinder.
Figure 6:
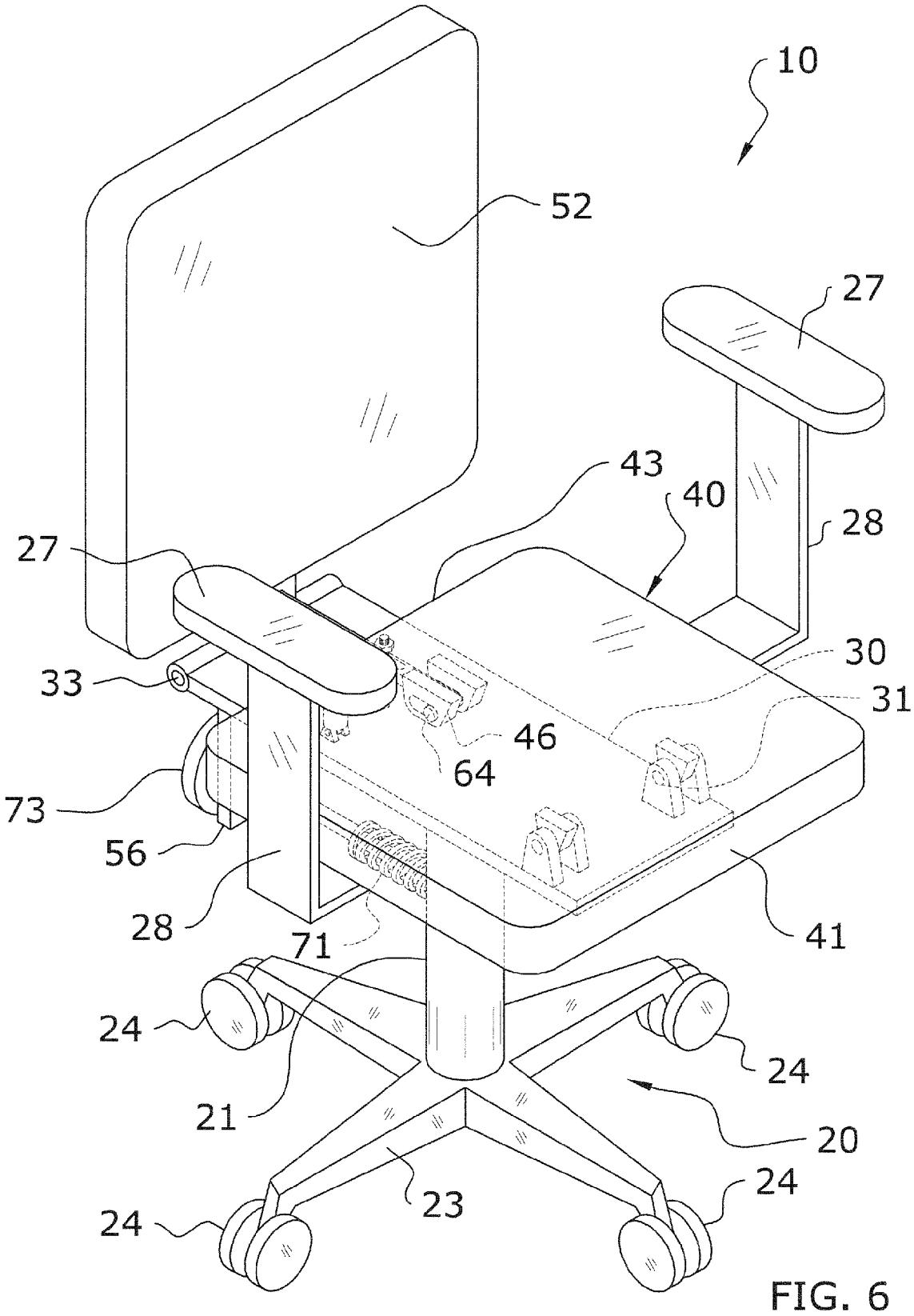
FIG. 6 is an upper perspective view of the present invention including arm rests.

Turning now descriptively to the drawings, in which similar reference characters denote similar elements throughout the several views, FIGS. 1 through 6 illustrate an office chair 10, which comprises a support module 21, a seat carrier 30, an initially forwardly declined seat member 40 articulated to the seat carrier 30 such as by being pivotal along a front end 41, and an initially rearwardly angled backrest carrier 50 having a backrest member 52, the carrier 50 articulated to the seat carrier 30 such as by being pivotal along a lower end or portion 56. The angular positions of the seat and backrest member 40, 52 are largely controlled and synchronous via an actuator arm 60 and adjustable spring arrangement 70, wherein the actuator arm 60 directly links the seat member 40 to the backrest carrier 50 and the spring arrangement 70 returns the backrest carrier 50 and seat member 40 to initial positions when a weighted load 12 is lessened or removed from the rear end 43 of the seat member 40. It is appreciated that the weighted load 12 may be placed towards the front end 41 of the seat member 40 to pivot the seat member 40 downwardly as long as the weighted load 12 is rearwardly of the front pivot 31, thus rear end 43 of the seat member 40 may refer to any point upon the seat member 40 rearward of the front pivot 31.

A pneumatic cylinder 80 to provide resistance to the seat member 40 and adjust the rate of pivotal adjustment of the seat member 40 and backrest member 52, a limiter 90 to limit a maximum and minimum angular position of the seat member 40 and thus accordingly backrest member 52, adjustable arm rests 27, and casters 24 may also be included with the chair 10 as will be described.

The present invention is generally employed as an office type chair, such as those used at a desk or computer, however it is appreciated that the present invention may be employed in chairs used in various other settings, such as a dining room setting, living or television room setting, outdoor setting, etc. As such, the seat members 40 and backrest members 52 may be altered to accommodate desired comfort levels, aesthetic appearance, and functional elements in accord with the desired environment.

B. Support Structure

The support structure 20 of the chair 10 may be portable or non portable as appreciated and generally includes a support module 21 comprised of a vertical column and a base 23 at a lower end of the support module 21. The base 23 may be of various shapes, such as a spider or multi-legged shape and may also have casters 24 at the ends for rolling the chair 10. Various types of casters 24 may be used, such as locking or non locking as appreciated. The support structure 20 may be comprised of various materials, such as plastic, metal, etc. all which provides adequate support for the chair 10.

The chair 10 may also include arm rests 27 extending upwards from the support structure 20, seat carrier 30, or from the backrest carrier 50, etc. The arm rests 27 generally supported by supports may be vertically, angularly, rotatably, laterally, or otherwise adjustable to accommodate the size of the user. The arm rests 27 may be adjusted in various manners conventional with various types of chairs 10. The support structure 20 may also vertically adjust to vertically adjust the height of the seat member 40.

C. Seat Carrier

The seat carrier 30 is generally mounted to the upper end of the support module 21 of the support structure 20. The seat carrier 30 is positioned within a horizontal plane and extends to a substantial front end 41 of the seat member 40 and past the rear end 43 of the seat member 40. The seat carrier 30 may be comprised of various materials, such as but not limited to plastic or metal.

The seat carrier 30 generally includes a front pivot 31, the front pivot 31 generally being raised from the seat carrier 30 to allow the front end 41 of the seat member 40 to pivot downwardly so the seat member 40 may be positioned in the forward declined position, which is the initial position of the seat member 40. As implied, the front pivot 31 is generally located near the front of the seat carrier 30. The front pivot 31 generally extends along a traverse axis of both the seat carrier 30 and seat member 40.

The seat carrier 30 also generally includes a rear pivot 33 also extending along traverse axis of the seat carrier 30. The rear pivot 33 connects the lower end of the backrest carrier 50 to the seat carrier 30 and also extends along a traverse axis of the backrest carrier 50. As implied, the rear pivot 33 is located at a rear of the seat carrier 30.

D. Seat Member

The seat member 40 may be comprised of various types of padded structures and generally includes a padded upper portion and a rigid or stiff lower portion, the padded upper portion being in contact with the seated user and the rigid or stiff lower portion being in pivotal connection with the front pivot 31 and also receiving the movable actuator arm 60, such as by having a slider engagement element or mechanism 46 attached thereto for guiding the slider 64 of the actuator arm 60.

As described, the front pivot 31 is connected to the bottom of the seat member 40 near the front end 41 of the seat member 40, such as spaced slightly rearwardly. The actuator arm 60 makes contact with the bottom of the seat member 40 near the center of the seat member 40 between the front end 41 and rear end 43 and moves forwardly along the bottom or lower portion of the seat member 40 a distance depending on the weighted load 12 on the seat member 40.

The seat member 40 is initially (when no weighted load 12 is upon the rear end 43) in a forwardly declined position meaning the front end 41 is lower than the rear end 43 of the seat member 40. When a weighted load 12 (i.e. seated user) is applied to the rear end 43 of the seat member 40, thus providing a downward force, the rear end 43 of the seat member 40 angularly adjusts downward thus moving the seat member 40 toward a more planar orientation and also possibly forwardly inclined depending upon the force of the weighted load 12 and the allotted space that the seat member 40 is able angularly adjust.

E. Backrest Carrier and Backrest Member

The backrest carrier 50 is pivotally connected, via the rear pivot 33, to the seat carrier 30 near a lower end, such as spaced slightly upward from the termination of the lower end. The backrest carrier 50 may be comprised of various shapes, but preferably employs a generally planar upper portion 51 and a generally planar lower portion 56, the lower portion 56 being rearwardly spaced from the upper portion 51, however both the upper portion 51 and the lower portion 56 being parallel. The lower portion 56 also preferably extends below the seat carrier 30 for allowing room for the spring arrangement 70 and providing a leverage point relative the rear pivot 33.

The upper portion 51 has a backrest member 52 attached thereto, generally in a fixed manner, that is parallel with the upper portion 51 and general orientation of the backrest carrier 50. As with the seat member 40, the backrest member 52 may employ various types of padded structures or materials and have various thicknesses. The backrest member 52 is generally located above the seat member 40. In the initial position (such as when a minimal or no weighted load 12 is placed upon the rear end 43 of the seat member 40), the backrest member 52 angles rearwardly, such that the upper end of the backrest member 52 and backrest carrier 50 are rearward of the lower end of the backrest member 52 and backrest carrier 50 with respect to the front end 41 and rear end 43 of the seat member 40.

F. Actuator Arm

The actuator arm 60 provides the direct linkage between the backrest carrier 50 and the seat carrier 30. The actuator arm 60 is generally comprised of a rigid and elongated structure, such as a rigid rod or member. The actuator arm 60 has a first end 61 that is angularly fixed to the lower portion 56 of the backrest carrier 50 above the seat carrier 30 and the actuator arm 60 has a second end 63 that is movable along the bottom 42 of the seat member 40 when a weighted load 12 is placed upon the rear end 43 of the seat member 40. The second end 63 may be comprised of a sliding mechanism, roller 64, or various other structures that are able to move along the bottom of the seat member 40 in a forward and rearward direction.

The actuator arm 60 is generally positioned entirely below the seat member 40 in the raised and lowered positions of the seat member 40. The actuator arm 60 is also generally perpendicular to the backrest carrier 50; however various angular positions may be appreciated. It is appreciated that by adjusting the angular position of location of the actuator arm 60 relative the seat member 40 and backrest carrier 50, the rate at which the backrest carrier 50 and backrest member 52 pivot or tilt may be adjusted relative the rate at which the seat member 40 pivots.

G. Biasing Arrangement

The biasing arrangement 70 provides a return force to the backrest carrier 50 and seat member 40. The biasing arrangement 70 is generally comprised of one or more tension springs 71; however alternate biasing mechanisms or types of springs may be appreciated. Preferably, the biasing arrangement 70 has a first end that is connected to the support module 21 beneath the seat carrier 30 and a second end that is connected to the backrest carrier 50 near the terminating part of the lower end of the lower portion 56.

The spring 71, when retracted, pulls the lower portion 56 of the backrest carrier 50 forwardly, which causes the upper portion 51 and backrest member 52 to angle rearwardly thus opening or enlarging an angle between the backrest member 52 and the seat member 40. When a downward force caused by the weighted load 12 is applied to the seat member 40, rearwardly of the front pivot 31, the downward force overcomes the force of the spring 71 which allows the upper portion 51 of the backrest carrier 50 to pivot forwardly via expanding the spring 71.

The biasing arrangement 70 also preferably includes an adjustment mechanism 73 for adjusting the tension of the spring 71, thus requiring a heavier or lighter weighted load 12 to be applied to the seat member 40 in order for the spring 71 to expand. The adjustment mechanism 73 may be configured in various manners, such as a threaded adjustment, etc.

H. Resistance Mechanism

The chair 10 may optionally include a resistance mechanism, such as but not limited to one or more pneumatic cylinders 80 may be used to apply an upward force to the seat member 40, thus slowing a downward pivotal movement of the seat member 40 or requiring a heavier weighted load 12 to pivotally move the seat member 40. The pneumatic cylinder 80 is generally located underneath the seat member 40 near the rear end 43 and is vertically oriented; having an upper end connected to the seat member 40 and a lower end supported by the seat carrier 30 or support structure 20. It is appreciated that by providing resistance to the seat member 40, the rate of pivotal adjustment of the seat member 40 and backrest member 52 may be adjusted by the pneumatic cylinder 80.

I. Stop Limiter

The chair 10 may also optionally include a stop limiter 90 to limit a pivotal movement and thus angular position of the seat member 40 and thus backrest member 52 via providing a limiting movement to the actuator arm 60. The stop limiter 90 may include an upper limit member 91 and a lower limit member 93. The upper limit member 91 stops or limits an upper movement of the actuator arm 60, thus limiting an amount that the seat member 40 may decline or rear end 43 may raise. The lower limit member 93 stops or limits a lowering movement of the actuator arm 60, thus limiting an amount that the seat member 40 may incline or move towards a planar orientation when a weighted load 12 is applied thereto.

The stop limiter 90 including the upper limit member 91 and/or the lower limit member 93 may be adjusted to adjust the maximum and minimum angular adjustment of the seat member 40. Various types of adjustment members may be used to vertically adjust the height of the upper limit member 91 and the lower limit member 93. The upper limit member 91 and the lower limit member 93 may be comprised of different types of structures, such as laterally projecting members, hooks, bolt operated, etc.

J. Operation of Preferred Embodiment

In use, the user sits upon the rear end 43 of the seat member 40 or behind the front pivot 31 causing the rear end 43 of the seat member 40 to pivotally lower (via the front pivot 31). As the seat member 40 pivots toward a lower position and thus planar or forwardly inclined orientation, the second end 63 and slider or roller 64 move forwardly along the bottom 42 of the seat member 40 either directly or through the use of a slider engagement element 46 which causes the first end 61 of the actuator arm 60 to pull forwardly upon the backrest carrier 50 and thus the backrest member 52 to pivot forwardly with the backrest carrier 50, thus providing synchronous pivotal movement of the backrest member 52 and seat member 40 so that the backrest member 52 may meet the back of the user which provides an automatic support for the user's back and spine afforded by the weight of the user. The support force upon the user's back is adjustable by decreasing or increasing the force of the spring 71 by the adjustment mechanism 73. The angle formed between the backrest member 52 and the seat member 40 thus lessens as more weight is applied to the rear end 43 of the seat member 40. The amount that the spring 71 expands also increases due to the lower portion 56 of the backrest carrier 50 moving further rearwardly away from the support module 21.

As the weighted load 12 is lessened or removed from the rear end 43 of the seat member 40, the return force of the spring 71 overcomes the weight of the backrest carrier 50 and seat member 40 and causes the lower portion 56 of the backrest carrier 50 to be pulled forwardly towards the support module 21 and thus the second end 63 and slider or roller 64 to move along the bottom of the seat member 40 in a rearward direction which causes the rear end 43 of the seat member 40 to raise and the seat member 40 to move back to a forwardly declined position, which is the initial position of the seat member 40, thus providing synchronous pivotal movement of the backrest member 52 and seat member 40. The angle formed between the backrest member 52 and the seat member 40 thus increases as less weight is applied to the rear end 43 of the seat member 40.

It is appreciated that the user may also lean forward while sitting upon the seat member 40 or sit upon the front end 41 of the seat member 40. By leaning forward or sitting upon the front end 41 of the seat member 40, a majority of the weighted load 12 is forward of the front pivot 31 which allows for the spring 71 to retract and keep the seat member 40 in the forwardly declined position and the backrest member 52 in the rearwardly angled position thus allowing the user to sit straight up and naturally restore the lumbar curve reducing stress on the discs in the spine.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An office chair having tiltable seat and backrest members, comprising:

a support module;

a seat carrier supported by said support module;

a seat member articulated to said seat carrier such as by being pivotal along a front end of said seat member, said seat member having a first initial position of being forwardly declined;

a backrest carrier having a backrest member, said backrest carrier articulated to said seat carrier such as by being pivotal along a lower end of said backrest carrier, said backrest carrier and said backrest member having a second initial position of being rearwardly angled;

an actuator arm directly linking said seat member to said backrest carrier; and a spring arrangement connected to said backrest carrier to return said backrest carrier and thus said seat member via said actuator arm to said first and second initial positions when a weighted load is lessened or removed from a rear end of said seat member, wherein said spring arrangement has an adjustment mechanism.

2. The office chair of claim 1, wherein said spring arrangement is connected on a first end to said lower end of said backrest carrier and on a second end to said support module.

3. The office chair of claim 1, wherein said spring arrangement is comprised of at least one tension spring.

4. The office chair of claim 1, wherein said actuator arm has a first end angularly fixed to said backrest carrier and a second end movable along a bottom of said seat member.

5. The office chair of claim 4, wherein said second end of said actuator arm is comprised of a sliding structure.

6. The office chair of claim 4, wherein said second end of said actuator arm is comprised of a roller.

7. The office chair of claim 4, wherein said actuator arm is perpendicular with an orientation of said backrest carrier.

8. The office chair of claim 1, including a resistance means connected to said rear end of said seat member for exerting an upward force upon said seat member.

9. The office chair of claim 8, wherein said resistance means is comprised of a pneumatic cylinder.

10. The office chair of claim 1, including a limiter means in communication with said actuator arm for limiting a maximum and minimum angular position of said seat member.

11. The office chair of claim 10, wherein said limiter means is adjustable to adjust said maximum and minimum angular position of said seat member.

12. A chair having tiltable seat and backrest members, comprising:

a seat carrier supported by a support structure;

a seat member articulated to said seat carrier such that said seat member is pivotal along a traverse axis adjacent a front end of said seat member;

a backrest carrier having a backrest member, said backrest carrier articulated to said seat carrier such that said backrest carrier is pivotal along a traverse axis adjacent a lower end of said backrest carrier;

an actuator arm connected to said backrest carrier below said seat member, said actuator arm having a first end connected to said backrest carrier and having a second end movable along a bottom of said seat member such that when a rear end of said seat member is moved from a raised position to a lowered position via a weighted load being applied thereto, said backrest carrier pivots forwardly with respect to said seat carrier via said second end of said actuator arm moving forwardly along said bottom of said seat member and said first end of said actuator arm pulling said backrest carrier forwardly; and a biasing arrangement connected to said backrest carrier for exerting a return force upon said backrest carrier to return said backrest carrier to an initial position, said initial position being rearwardly angled, said biasing arrangement adapted to execute said return force when said return force is greater than a downward force of said weighted load upon said rear end of said seat member.

13. The chair of claim 12, wherein said biasing arrangement has an adjustment mechanism, said adjustment mechanism for adjusting said return force.

14. The chair of claim 12, wherein said biasing arrangement is connected on a first end to said lower end of said backrest carrier and on a second end to said support structure and wherein said biasing arrangement is comprised of at least one tension spring.

15. The chair of claim 12, wherein said second end of said actuator arm is comprised of a sliding structure.

16. The chair of claim 12, wherein said second end of said actuator arm is comprised of a roller.

17. The chair of claim 12, wherein said first end of said actuator arm is angularly fixed to said backrest carrier.

18. The chair of claim 17, wherein said actuator arm is perpendicular with an orientation of said backrest carrier.

19. An office chair having tiltable seat and backrest members, comprising:

a wheeled support module;

a seat carrier supported by said support module;

a seat member articulated to said seat carrier such that said seat member is pivotal along a front end of said seat member, said seat member having an initial position of being forwardly declined;

a backrest carrier having a backrest member, said backrest carrier articulated to said seat carrier such that said backrest carrier is pivotal along a lower end of said backrest carrier;

an actuator arm connected to said backrest carrier below said seat member, said actuator arm having a first end angularly fixed in a perpendicular manner to said backrest carrier and having a second end movable along a bottom of said seat member such that when a rear end of said seat member is moved from a raised position to a lowered position via a weighted load being applied thereto, said backrest carrier pivots forwardly with respect to said seat carrier via said second end of said actuator arm moving forwardly along said bottom of said seat member and said first end of said actuator arm pulling said backrest carrier forwardly;

a spring arrangement connected to said backrest carrier for exerting a return force upon said backrest carrier to return said backrest carrier to an initial position of said backrest carrier, said initial position of said backrest carrier being rearwardly angled, said spring arrangement adapted to execute said return force when said return force is greater than a downward force of said weighted load upon said rear end of said seat member;

an adjustment mechanism connected to said spring arrangement for adjusting a tension of said spring arrangement and thus increasing or decreasing said return force applied to said backrest carrier;

a pneumatic cylinder connected to said rear end of said seat member for exerting an upward force upon said seat member, said upward force adapted to provide resistance to a downward movement of said rear end said seat member;

a limiter means in communication with said actuator arm for limiting a pivotal movement of said actuator arm and said backrest carrier and thus limiting a vertical movement of said rear end of said seat member, said limiter means having an upper limit means and a lower limit means; and a pair of arm rests, each positioned on a side of said seat member, said arm rests each having adjustment means for pivotal and height adjustment.

20. An office chair having tiltable seat and backrest members, comprising:

a support module;

a seat carrier supported by said support module;

a seat member articulated to said seat carrier such as by being pivotal along a front end of said seat member, said seat member having a first initial position of being forwardly declined;

a backrest carrier having a backrest member, said backrest carrier articulated to said seat carrier such as by being pivotal along a lower end of said backrest carrier, said backrest carrier and said backrest member having a second initial position of being rearwardly angled;

an actuator arm directly linking said seat member to said backrest carrier, wherein said actuator arm has a first end angularly fixed to said backrest carrier and a second end movable along a bottom of said seat member; and a spring arrangement connected to said backrest carrier to return said backrest carrier and thus said seat member via said actuator arm to said first and second initial positions when a weighted load is lessened or removed from a rear end of said seat member.

21. The office chair of claim 20, wherein said spring arrangement has an adjustment mechanism.

22. The office chair of claim 20, wherein said spring arrangement is connected on a first end to said lower end of said backrest carrier and on a second end to said support module.

23. The office chair of claim 20, wherein said spring arrangement is comprised of at least one tension spring.

24. The office chair of claim 20, wherein said second end of said actuator arm is comprised of a sliding structure.

25. The office chair of claim 20, wherein said second end of said actuator arm is comprised of a roller.

26. The office chair of claim 20, wherein said actuator arm is perpendicular with an orientation of said backrest carrier.

27. The office chair of claim 20, including a resistance means connected to said rear end of said seat member for exerting an upward force upon said seat member.

28. The office chair of claim 27, wherein said resistance means is comprised of a pneumatic cylinder.

29. The office chair of claim 20, including a limiter means in communication with said actuator arm for limiting a maximum and minimum angular position of said seat member.

30. The office chair of claim 29, wherein said limiter means is adjustable to adjust said maximum and minimum angular position of said seat member.

* * * * *